US010823002B2

(12) United States Patent
Ganiger et al.

(10) Patent No.: US 10,823,002 B2
(45) Date of Patent: Nov. 3, 2020

(54) VARIABLE STIFFNESS STATIC STRUCTURE

(71) Applicant: General Electric Company, Schenectady, NY (US)

(72) Inventors: Ravindra Shankar Ganiger, Bangalore (IN); Praveen Sharma, Bangalore (IN); Shuvajyoti Ghosh, Bangalore (IN); Amit Zutshi, Mason, OH (US); Raghavendra Muralidhar, Bangalore (IN); Rangasai Madoor Comandore, Bangalore (IN)

(73) Assignee: General Electric Company, Schenectady, NY (US)

( * ) Notice: Subject to any disclaimer, the term of this patent is extended or adjusted under 35 U.S.C. 154(b) by 165 days.

(21) Appl. No.: 15/979,982

(22) Filed: May 15, 2018

(65) Prior Publication Data

US 2019/0353051 A1 Nov. 21, 2019

(51) Int. Cl.
*F01D 25/16* (2006.01)

(52) U.S. Cl.
CPC ..... *F01D 25/164* (2013.01); *F05D 2240/50* (2013.01); *F05D 2260/52* (2013.01); *F05D 2300/50212* (2013.01)

(58) Field of Classification Search
CPC ..... F01D 25/164; F05D 2240/50; F05D 2260/05; F05D 2300/50212
See application file for complete search history.

(56) References Cited

U.S. PATENT DOCUMENTS

| | | | | |
|---|---|---|---|---|
| 4,451,110 | A * | 5/1984 | Forestier | F01D 25/164 384/582 |
| 5,052,828 | A | 10/1991 | Ciokajlo et al. | |
| 5,658,125 | A | 8/1997 | Burns et al. | |
| 8,662,756 | B2 | 3/2014 | Care et al. | |
| 8,727,632 | B2 | 5/2014 | Do et al. | |
| 9,121,305 | B2 | 9/2015 | Nicholson | |
| 9,121,448 | B2 | 9/2015 | Delgado Marquez et al. | |
| 9,297,310 | B2 | 3/2016 | Giri et al. | |
| 9,447,817 | B2 | 9/2016 | Gallimore et al. | |
| 9,476,320 | B2 | 10/2016 | Savela | |
| 9,546,570 | B2 | 1/2017 | Fletcher et al. | |
| 9,638,062 | B2 | 5/2017 | Davis | |
| 9,644,541 | B2 | 5/2017 | Morreale et al. | |
| 9,856,751 | B2 | 1/2018 | Duong et al. | |
| 2006/0045404 | A1* | 3/2006 | Allmon | F01D 25/164 384/581 |
| 2009/0074560 | A1* | 3/2009 | Madison | F01D 25/16 415/106 |

(Continued)

*Primary Examiner* — Aaron R Eastman
*Assistant Examiner* — Theodore C Ribadeneyra
(74) *Attorney, Agent, or Firm* — Dority & Manning, P.A.

(57) ABSTRACT

A turbine engine including a first static structure comprising a first material defining a first thermal expansion coefficient and a second static structure comprising a second material defining a second thermal expansion coefficient different from the first thermal expansion coefficient. The first static structure and the second static structure are together disposed in adjacent arrangement along a load direction. The first static structure and the second static structure together selectively define a gap therebetween along the load direction based at least on a load difference between the first static structure and the second static structure.

20 Claims, 6 Drawing Sheets

(56) References Cited

U.S. PATENT DOCUMENTS

| | | | | |
|---|---|---|---|---|
| 2010/0209232 | A1* | 8/2010 | Stein | F01D 17/165 415/148 |
| 2012/0213629 | A1* | 8/2012 | Rouesne | F01D 25/164 415/170.1 |
| 2013/0108202 | A1* | 5/2013 | Do | F01D 25/164 384/572 |
| 2013/0280063 | A1* | 10/2013 | Ganiger | F16C 19/54 415/229 |
| 2014/0060083 | A1* | 3/2014 | Savela | F01D 25/164 60/805 |
| 2016/0186596 | A1* | 6/2016 | Tatman | F01D 25/246 415/1 |
| 2016/0341070 | A1 | 11/2016 | Garcia et al. | |
| 2017/0030223 | A1 | 2/2017 | Parry et al. | |
| 2017/0051629 | A1 | 2/2017 | Sutherland | |
| 2017/0089353 | A1 | 3/2017 | Zhang et al. | |
| 2017/0145855 | A1 | 5/2017 | Ganiger et al. | |
| 2017/0234158 | A1 | 8/2017 | Savela | |
| 2017/0248191 | A1 | 8/2017 | Husband et al. | |
| 2018/0320552 | A1* | 11/2018 | Harris | F01D 9/065 |
| 2018/0371948 | A1* | 12/2018 | Lepretre | F01D 25/246 |

* cited by examiner

VARIABLE STIFFNESS STATIC STRUCTURE

FIELD

The present subject matter relates generally to variable stiffness static members for turbine engines.

BACKGROUND

Mechanical structures, including static casings surrounding rotary structures such as turbine engines, generally include structural members defining a single linear stiffness, or load versus deflection, for each load member. However, load changes or deflections may define a linear behavior based on operating conditions of the mechanical structure to which the structural member is defined. As such, known structural members may define limited ranges of operability relative to load or deflection behaviors of the mechanical structure to which the structural member is attached. Therefore, there is a need for improved stiffness properties for structural members for mechanical structures.

BRIEF DESCRIPTION

Aspects and advantages of the invention will be set forth in part in the following description, or may be obvious from the description, or may be learned through practice of the invention.

The present disclosure is directed to a turbine engine including a first static structure comprising a first material defining a first thermal expansion coefficient and a second static structure comprising a second material defining a second thermal expansion coefficient different from the first thermal expansion coefficient. The first static structure and the second static structure are together disposed in adjacent arrangement along a load direction. The first static structure and the second static structure together selectively define a gap therebetween along the load direction based at least on a load difference between the first static structure and the second static structure.

In various embodiments, the engine further includes a coupling member attaching together the first static structure and the second static structure. The coupling member at least partially defines a nominal position of the gap between the first static structure and the second static structure. In one embodiment, the coupling member is at least partially extended along the load direction. The coupling member defines a spring structure enabling increase and decrease of the gap between the first static structure and the second static structure. In various embodiments, the coupling member comprises a first member and a second member. The first member and the second member are each coupled together and extend from one another at an angle less than approximately 90 degrees and greater than approximately 15 degrees. In one embodiment, the first member defines a substantially vertical member and the second member defines an at least partially horizontal member. In another embodiment, the second member is coupled to the second static structure.

In various embodiments, the second member defines a first portion defining a first stiffness and a second portion defining a second stiffness greater than the first stiffness. In one embodiment, the second portion is coupled to the second static structure. The gap is defined between the first portion and the second static structure. In another embodiment, the second member further defines a third portion. The gap is defined between the third portion and the second static structure.

In still various embodiments, the second member is coupled to a rotary component. In one embodiment, the rotary component at least partially defines a rolling element of a bearing assembly. In another embodiment, the second member at least partially defines a bearing surface.

In one embodiment, the first thermal expansion coefficient is higher than the second thermal expansion coefficient.

In another embodiment, the gap is variable between approximately 0.040 millimeters and zero millimeters.

In still another embodiment, the first static structure and the second static structure together at least partially define a bearing assembly.

Another aspect of the present disclosure is directed to a structural support assembly. The structural support assembly includes a first static structure comprising a first material defining a first thermal expansion coefficient, and a second static structure comprising a second material defining a second thermal expansion coefficient different from the first thermal expansion coefficient. The first static structure and the second static structure are together disposed in adjacent arrangement along a load direction. The first static structure and the second static structure together selectively define a gap therebetween along the load direction based at least on a load difference between the first static structure and the second static structure.

In various embodiments, the structural support assembly further includes a coupling member attaching together the first static structure and the second static structure. The coupling member at least partially defines a nominal position of the gap between the first static structure and the second static structure. In one embodiment, the coupling member includes a first member and a second member. The first member and the second member are each coupled together and extend from one another at an angle less than approximately 90 degrees and greater than approximately 15 degrees.

In one embodiment, the second member defines a first portion defining a first stiffness and a second portion defining a second stiffness greater than the first stiffness.

In another embodiment, the structural support assembly defines a bearing assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
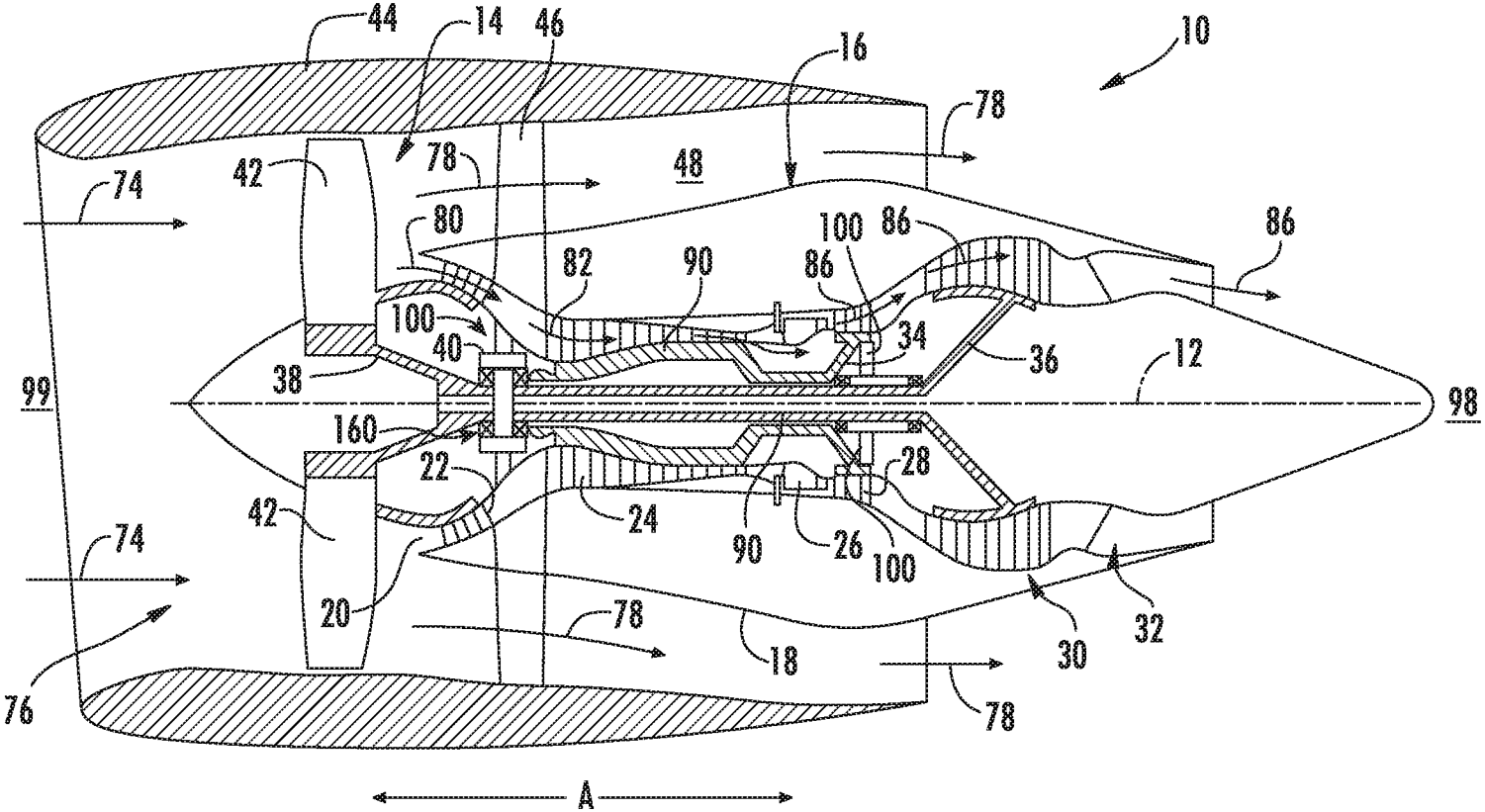
FIG. 1 is an exemplary embodiment of a turbine engine including a static support assembly according to an aspect of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of turbine engines including variable stiffness static support assemblies shown and described herein may provide improved stiffness properties for structural members. The embodiments of the static support assemblies generally shown and described herein include gaps between two or more structures to selectively close or open based on changes in thermal or centrifugal loading from a rotor assembly as engine operating conditions change. As the gap closes or opens, the static support assembly defines two or more stiffness versus operational parameter slopes such as to improve the stiffness properties of the static support relative to the rotor assembly. Such improved stiffness properties may improve engine operation defining a bowed rotor condition, mitigate deleterious effects of rotor unbalance, tighten clearances, or improve engine start times (e.g., turnaround times), thereby improving engine efficiency.

Referring now to the drawings, FIG. 1 is a schematic partially cross-sectioned side view of an exemplary gas turbine engine 10 herein referred to as "engine 10" as may incorporate various embodiments of the present invention. Although further described herein as a turbofan engine, the engine 10 may define a turboshaft, turboprop, or turbojet gas turbine engine, including marine and industrial engines and auxiliary power units. As shown in FIG. 1, the engine 10 has a longitudinal or axial centerline axis 12 that extends therethrough for reference purposes. An axial direction A is extended co-directional to the axial centerline axis 12 for reference. The engine 10 further defines an upstream end 99 and a downstream end 98 for reference. In general, the engine 10 may include a fan assembly 14 and a core engine 16 disposed downstream from the fan assembly 14.

The core engine 16 may generally include a substantially tubular outer casing 18 that defines a core inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 via a reduction gear 40 such as in an indirect-drive or geared-drive configuration.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. It should be appreciated by those of ordinary skill in the art that the nacelle 44 may be configured to be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

It should be appreciated that combinations of the shaft 34, 36, the compressors 22, 24, and the turbines 28, 30 define a rotor assembly 90 of the engine 10. For example, the HP shaft 34, HP compressor 24, and HP turbine 28 may define an HP rotor assembly of the engine 10. Similarly, combinations of the LP shaft 36, LP compressor 22, and LP turbine 30 may define an LP rotor assembly of the engine 10. Various embodiments of the engine 10 may further include the fan shaft 38 and fan blades 42 as the LP rotor assembly. In other embodiments, the engine 10 may further define a fan rotor assembly at least partially mechanically de-coupled from the LP spool via the fan shaft 38 and the reduction gear 40. Still further embodiments may further define one or more intermediate rotor assemblies defined by an intermediate pressure compressor, an intermediate pressure shaft, and an intermediate pressure turbine disposed between the LP rotor assembly and the HP rotor assembly (relative to serial aerodynamic flow arrangement).

During operation of the engine 10, a flow of air, shown schematically by arrows 74, enters an inlet 76 of the engine 10 defined by the fan case or nacelle 44. A portion of air, shown schematically by arrows 80, enters the core engine 16 through the core inlet 20 defined at least partially via the outer casing 18. The flow of air 80 is increasingly compressed as it flows across successive stages of the compressors 22, 24, such as shown schematically by arrows 82. The compressed air 82 enters the combustion section 26 and mixes with a liquid or gaseous fuel and is ignited to produce combustion gases 86. The combustion gases 86 release energy to drive rotation of the HP rotor assembly and the LP rotor assembly before exhausting from the jet exhaust nozzle section 32. The release of energy from the combustion gases 86 further drives rotation of the fan assembly 14, including the fan blades 42. A portion of the air 74 bypasses the core engine 16 and flows across the bypass airflow passage 48, such as shown schematically by arrows 78.

The engine 10 further includes a plurality of static support assemblies 100 disposed at the rotor assemblies 90 of the engine 10. The static support assemblies 100 each support rotation of the rotor assembly 90. Embodiments of the static support assembly 100 may generally define a bearing assembly or a gear assembly, such as a static support for the reduction gear 40. The static support assembly 100 defining a bearing assembly may generally include inner and outer casings and manifolds or conduits to supply and scavenge lubricant. The static support assembly 100 defining a bearing assembly may further include a damper assembly providing a flow of air or other fluid to dampen or limit vibrations, oscillations, or unbalance from the rotor assembly 90 during operation of the engine 10. The static support assembly 100 generally requires a lubricant, such as oil, to enable rotation of the rotor assembly, reduce heat or thermal accumulation at the static support assembly 100, and provide damping of vibrations from rotation of the rotor assembly 90.

Figure 2:
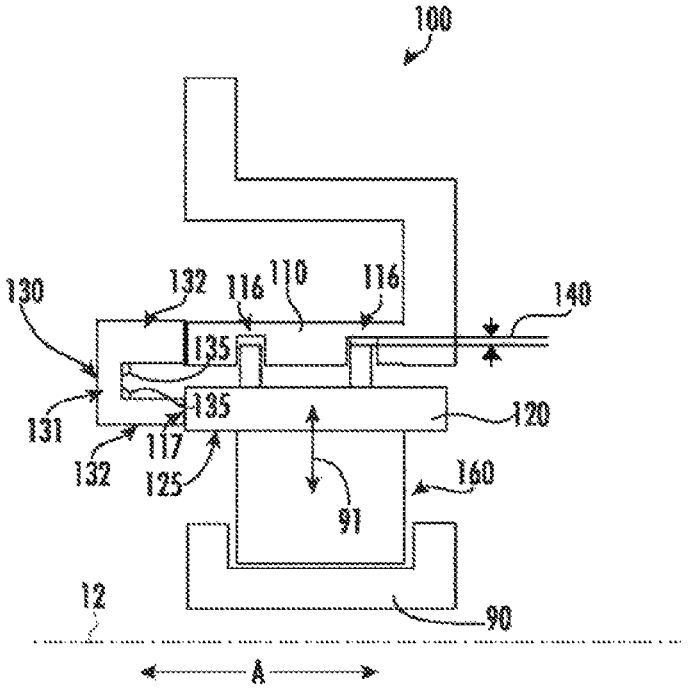
FIGS. 2-5 are exemplary embodiments of the static support assembly according to aspects of the present disclosure.

Referring now to FIG. 2, the static support assembly 100 includes a first static structure 110 and a second static structure 120. The first static structure 110 includes a first material defining a first thermal expansion coefficient. The second static structure 120 includes a second material defining a second thermal expansion coefficient different from the first thermal expansion coefficient of the first material. The first static structure 110 and the second static structure 120 are together disposed in adjacent arrangement along a load direction, shown schematically by arrows 91. The first static structure 110 and the second static structure 120 together selectively define a gap dimension 140 therebetween along the load direction 91. A magnitude of the gap dimension 140 is based at least on a load difference (e.g., thermal loading, centrifugal loading, centripetal loading, etc.) between the first static structure 110 and the second static structure 120.

In various embodiments, the first thermal expansion coefficient is higher than the second thermal expansion coefficient. As such, the first material of the first static structure 110 expands, contracts, or otherwise deflects at a rate different from the second material of the second static structure 120. Therefore, the difference in the thermal expansion coefficients of the first material and the second material enable differences in the gap dimension 140 relative changes in thermal loading, centrifugal loading, or other load conditions based on an operational parameter of the engine 10.

Operation of the engine 10 shown and described in regard to FIGS. 1-2 generates thermal and centrifugal loads from the rotor assembly 90 that vary as a function of the operational parameters or operating conditions of the engine 10. For example, as the rotor assembly 90 increases in rotational speed, the engine 10 produces increasing magnitudes of thrust. The increasing magnitudes of thrust correspond to the increasing loads along the load direction 91. As another example, increasing rotational speeds of the rotor assembly 90 substantially corresponding to increasing thrust loads and increasing temperatures cause the gap dimension 140 to decrease toward zero due to the different thermal expansion coefficients between the first material and the second material of the first static structure 110 and the second static structure 120, respectively. As such, the operational parameters may generally include one or more of a thrust output of the engine 10, a temperature one or more of the first static structure 110 and/or the second static structure 120, or a rotational speed of the rotor assembly 90, or combinations thereof.

In various embodiments, the gap dimension 140 defines a nominal or zero load gap of approximately 0.040 millimeters. However, it should be appreciated that the gap dimension 140 is defined based on a configuration of the engine 10. As such, the nominal or zero load gap condition may be greater or lesser. The first material of the first static structure 110 and the second material of the second static structure 120 enable the selective opening and closing of the gap dimension 140 corresponding to the engine condition and a desired stiffness of the static support assembly 100. As another example, at relatively low power conditions (e.g., startup and ignition, idle conditions, etc.), the presence of the gap dimension 140 enables a lower transfer of loads along the load direction 91. In contrast, at high power conditions (e.g., full load condition, takeoff, etc.) the gap dimension 140 is zero such as to enable full load transfer along the load direction 91. Such selective change in load condition at the static support assembly 100 may further provide sufficient stiffness at various conditions while enabling adaptive response (e.g., lower vibratory responses) at low power conditions when the engine 10 defines a bowed rotor condition at the rotor assembly 90 (i.e., eccentricity of the rotor assembly 90 relative to the axial centerline 12 due to asymmetric circumferential and/or radial thermal gradients).

Referring now to FIGS. 2-5, the static support assembly 100 may further include a coupling member 130 attaching together the first static structure 110 and the second static structure 120. In various embodiments, the coupling member 130 may more specifically be a portion of the first static structure 110. For example, the coupling member 130 may define the first material defining the first thermal expansion coefficient. The coupling member 130 at least partially defines a nominal position of the gap dimension 140 between the first static structure 110 and the second static structure 120. The coupling member 130 is at least partially extended along the load direction 91. The coupling member 130 defines a spring structure enabling increase and decrease of the gap dimension 140 between the first static structure 110 and the second static structure 120 during operation of the engine 10. Various embodiments of the spring structure adjust the gap dimension 140 based on a difference in surface temperature at the first static structure 110 versus the second static structure 120.

For example, in various embodiments, the coupling member 130 includes a first member 131 and a second member 132. The first member 131 and the second member 132 may together define the springing structure. The first member 131 and the second member 132 are each coupled together and extend from one another. In various embodiments, the first member 131 and the second member 132 each extend from one another at an angle 135 less than or equal to approximately 90 degrees and greater than approximately 15 degrees.

In various embodiments, such as generally depicted in regard to FIGS. 2-5, the first member 131 and the second member 132 are together disposed at an angle 135 of approximately 90 degrees. The first member 131 and the second member 132 may together define a relatively soft hairpin structure or spring such as to enable deflection along the load direction 91 based on changes in loading (e.g., changes in engine operating condition or thrust output, changes in temperature, etc.). As such, the first member 131 and the second member 132 selectively change angles 135 based on the loading or thermal condition at the first static structure 110 and the second static structure 120.

Figure 3:
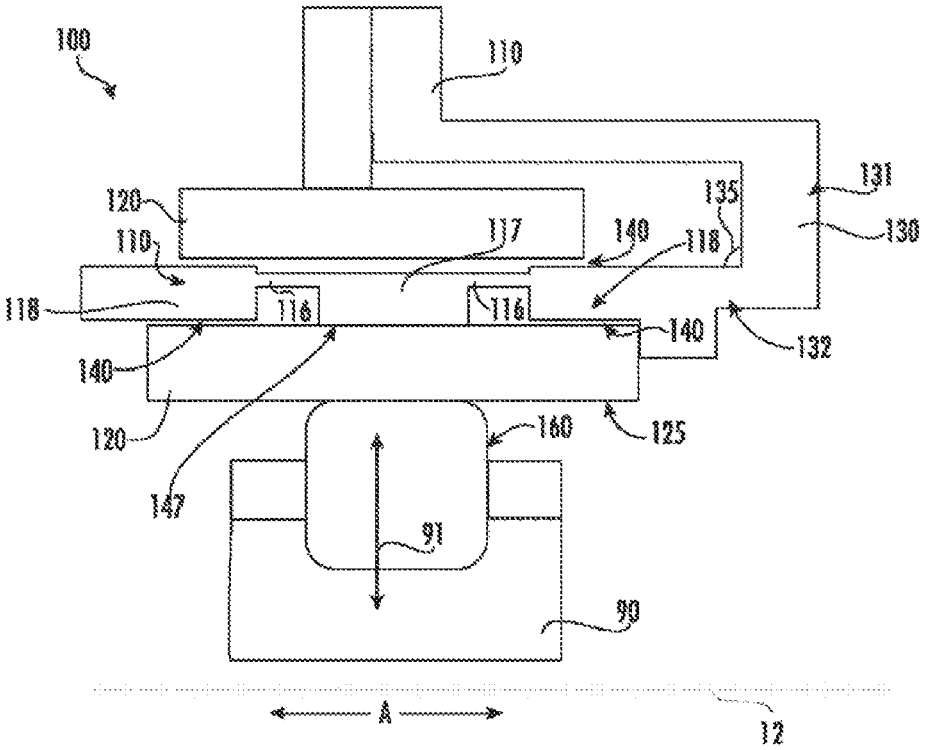
Figure 4:
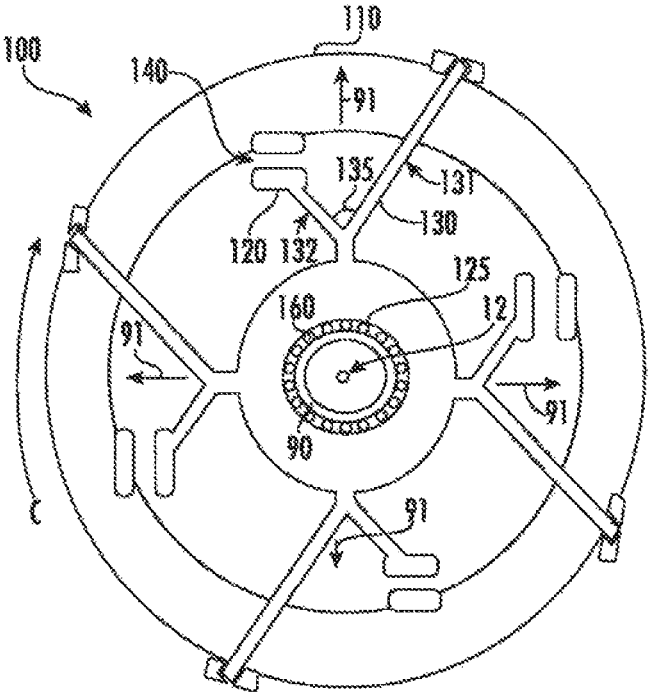
Figure 5:
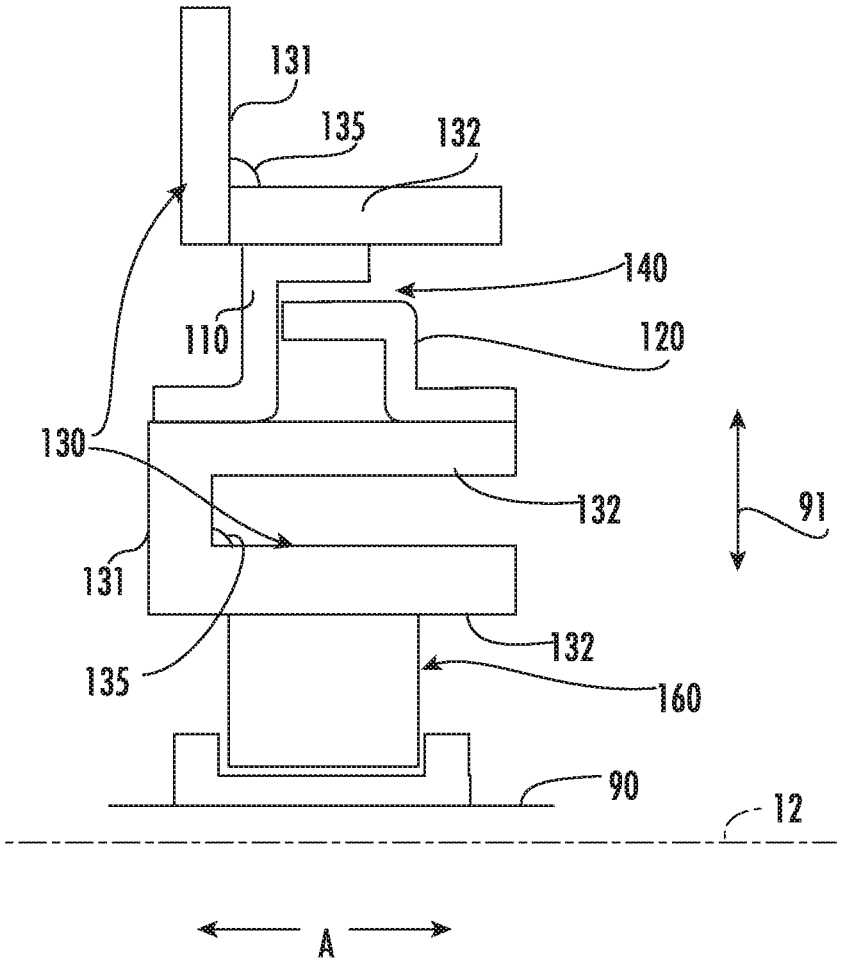

Referring to the embodiments generally depicted in FIGS. 2-3, the first member 131 and the second member 132 may together define a substantially L or C cross section. For example, the first member 131 may generally define a substantially vertical member and the second member 132 may generally define an at least partially horizontal member. Referring to the embodiment generally depicted in FIG. 4, the first member 131 and the second member 132 may together define a substantially Y or V cross section. In the various embodiments generally depicted in regard to FIGS. 2-5, the first member 131 and the second member 132 are extended at least partially along a radial direction from the axial centerline 12 or the load direction 91.

Referring still to FIGS. 2-5, the second member 132 is coupled to the second static structure 120. For example, referring to FIG. 2, the second member 132 is coupled to the second static structure 120 in adjacent arrangement along the axial direction A. Changes in load along the load direction 91 are reacted to via changes to the angle 135 between the first member 131 and the second member 132. Additionally, or alternatively, as the second static structure 120 defining the second thermal expansion coefficient reacts to increased thermal loading corresponding to increased rotor assembly 90 rotational speed and thrust generation of the engine 10 the gap dimension 140 decreases to zero at a desired speed, temperature, or thrust threshold of the engine 10.

In various embodiments, the desired threshold corresponds to a rotational speed or surface temperature of the rotor assembly 90 or thrust output of the engine 10 corresponding to an operating condition greater than a low power or ground idle condition. In still various embodiments, the desired threshold corresponds to a rotational speed or surface temperature of the rotor assembly 90 or thrust output of the engine 10 corresponding to an operating condition at or greater than a mid-power or cruise condition. In still yet various embodiments, the desired threshold corresponds to a rotational speed or surface temperature of the rotor assembly 90 or thrust output of the engine 10 corresponding to an operating condition at a high power or takeoff condition. Still further, it should be appreciated that the surface temperature of the rotor assembly 90 is proximate to the static support assembly 100 to which the rotor assembly 90 is attached. For example, referring to FIGS. 2-5, the engine 10 generally includes a rotary component 160. In various embodiments, the surface temperature of the rotor assembly 90 is relative to the rotary component 160 coupled to the rotor assembly 90. In other embodiments, the surface temperature of the rotor assembly 90 is relative to the second static structure 120 coupled to the rotor assembly 90 via the rotary component 160.

In various embodiments, the rotary component 160 defines a rolling element bearing assembly coupled to the rotor assembly 90 and the second static structure 120. In various embodiments, the second static structure 120 defines a bearing or contact surface 125 onto which the rotary component 160 is coupled to the second static structure 120. For example, the rotary component 160 defining a rolling element bearing assembly may define a roller bearing, a tapered roller bearing, a thrust or ball bearing, a needle roller, or gear bearing, or other suitable rolling element bearings in contact with the second static structure 120 at the bearing or contact surface 125. However, it should be appreciated that in other embodiments, the rotary component 160 may define a journal bearing or fluid film bearing enabling rotation of the rotor assembly 90 relative to the second static structure 120. For example, the rotary component 160 may define a fluid film defining air, lubricant, hydraulic fluid, fuel, or combinations thereof, or another suitable fluid film medium between the rotor assembly 90 and the static support assembly 100.

Referring back to FIGS. 2-3, the second member 132 may further define a first portion 116 defining a first stiffness and a second portion 117 defining a second stiffness greater than the first stiffness. In one embodiment, the second portion 117 is coupled to the second static structure 120. Referring to FIG. 2, the second member 132 may be coupled to the second static structure 120 in adjacent arrangement along the axial direction A. Referring to FIG. 3, the second member 132 is coupled to the second static structure 120 in adjacent arrangement along the load direction 91. More specifically, the second member 132 may be coupled to the second static structure 120 along the load direction 91 at the second portion 117. For example, the second static structure 120 and the second portion 117 of the second member 132 may define an interference fit or friction fit fastening the second static structure 120 to the second portion 117.

In various embodiments, the first portion 116 of the second member 132 may define a thinner cross sectional area than the second portion 117, such as to define a first stiffness less than the second stiffness at the second portion 117. In still various embodiments, the gap dimension 140 between the first static structure 110 and the second static structure 120 is defined between the first portion 116 of the second member 132 and the second static structure 120.

In one embodiment, such as generally depicted in regard to FIG. 3, the second member 132 may further define a third portion 118. In various embodiments, the gap dimension 140 is defined between the third portion 118 of the second member 132 and the second static structure 120.

Figure 6:
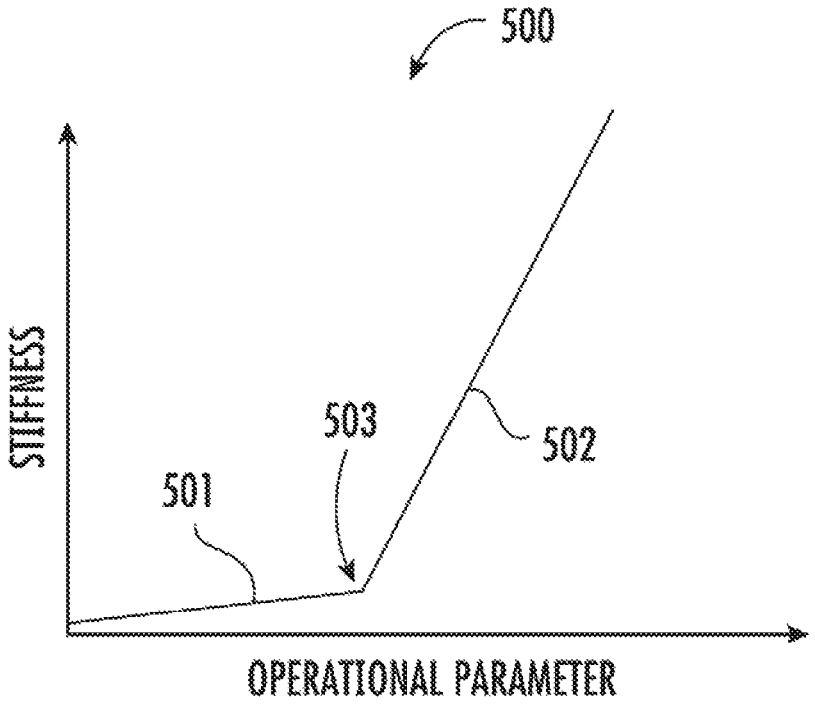
FIG. 6 is a graph depicting changes in stiffness of the static support assembly relative to a rotor assembly as a function of an operating parameter of the engine generally provided in regard to FIG. 1.

Referring now to FIG. 6, an exemplary graph 500 depicting an exemplary relationship between an operational parameter of the engine 10 and the variable stiffness of the static support assembly 100 is generally provided. In various embodiments, the operational parameter may generally include one or more of a thrust output of the engine 10, a temperature one or more of the first static structure 110 and/or the second static structure 120, or a rotational speed of the rotor assembly 90, or combinations thereof. As stiffness is the slope of load (e.g., the thermal or centrifugal load applied along the load direction 91) versus deflection (e.g., corresponding to changes in the angle 135 and/or the gap dimension 140 along the load direction 91), as loads increase with the increasing operational parameter the graph 500 depicts a first slope 501 of the stiffness of the static support assembly 100 versus the operational parameter. At the desired threshold corresponding to the operational parameter, such as depicted at 503, the graph 500 depicts a second slope 502 of the stiffness versus the operational parameter. The threshold 503 corresponds substantially to the gap dimension 140 closing to zero. For example, the threshold 503 corresponds substantially to the second static structure 120 contacting the first static structure 110 when the gap dimension 140 closes to zero. In various examples, the threshold 503 corresponds substantially to the second static structure 120 contacting the first portion 116 or the third portion 118 of the second member 132. Similarly, when the operational parameter decreases below the threshold 503, the gap dimension 140 opens to greater than zero and the static support assembly 100 relative to the rotor assembly 90 defines the first slope 501.

It should be appreciated that in various embodiments, the increasing and decreasing operational parameter may correspond to accelerations or decelerations of the rotor assembly 90. In still various embodiments, changes in the operational parameter may correspond substantially directly to increases or decreases in a thermal gradient between the first static structure 110 and the second static structure 120. In still yet various embodiments, changes in the operational parameter may correspond substantially directly to thrust output of the engine 10. In other embodiments, the operational parameter may include one or more other parameters substantially directly related to changes in rotational speed of the rotor assembly 90 or thermal or centrifugal loads generated from the rotor assembly 90. In still another embodiment, the threshold 503 may further correspond to a desired operational parameter relative to mitigating an undesired vibratory mode or condition. For example, the undesired vibratory mode may correspond to a bowed rotor condition and mitigating deleterious effects of accelerating the rotor assembly 90 defining the bowed rotor condition.

All or part of the engine 10 or static support assembly 100 including the first static structure 110, the second static structure 120, the coupling member 130, and/or portions thereof, or other elements shown and described herein, may be part of a single, unitary component and may be manufactured from any number of processes commonly known by one skilled in the art. These manufacturing processes include, but are not limited to, those referred to as "additive manufacturing" or "3D printing". Additionally, any number of forging, casting, machining, welding, brazing, or sintering processes, or any combination thereof may be utilized to construct the engine 10 and the elements shown and described herein. Furthermore, the engine 10 may constitute one or more individual components that are mechanically joined (e.g. by use of bolts, nuts, rivets, or screws, or welding or brazing processes, or combinations thereof) or are positioned in space to achieve a substantially similar geometric results as if manufactured or assembled as one or more components. Non-limiting examples of suitable materials include nickel and cobalt-based materials and alloys, iron or steel based materials and alloys, titanium-based materials and alloys, aluminum-based materials and alloys, composite materials, or combinations thereof. Still further, combinations of materials such as described above may be utilized to define one or more of the first thermal expansion coefficient of the first material and the second thermal expansion coefficient of the second material different from the first material.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine engine, the engine comprising:

a first static structure comprising a first material defining a first thermal expansion coefficient; and a second static structure comprising a second material defining a second thermal expansion coefficient different from the first thermal expansion coefficient, wherein the first static structure and the second static structure are together disposed in adjacent arrangement along a load direction, and wherein the first static structure and the second static structure together selectively define a gap dimension therebetween along the load direction to vary between a value greater than zero and zero based at least on a load difference between the first static structure and the second static structure.

2. The turbine engine of claim 1, further comprising:

a coupling member attaching together the first static structure and the second static structure and further wherein the coupling member at least partially defines a nominal position of the gap dimension between the first static structure and the second static structure.

3. The turbine engine of claim 2, wherein the coupling member is at least partially extended along the load direction, and wherein the coupling member defines a spring structure allowing increase and decrease of the gap dimension between the first static structure and the second static structure.

4. The turbine engine of claim 2, wherein the coupling member comprises a first member and a second member, wherein the first member and the second member are each coupled together and extend from one another at an angle less than 90 degrees and greater than approximately 15 degrees.

5. The turbine engine of claim 4, wherein the first member defines a substantially vertical member extending in a vertical direction of the turbine engine and the second member defines an at least partially horizontal member extending at least partially in a horizontal direction of the turbine engine.

6. The turbine engine of claim 5, wherein the second member is coupled to the second static structure.

7. The turbine engine of claim 2, wherein the coupling member comprises a first member and a second member, and wherein the second member defines a first portion defining a first stiffness and a second portion defining a second stiffness greater than the first stiffness.

8. The turbine engine of claim 7, wherein the second portion is coupled to the second static structure and wherein the gap dimension is defined between the first portion and the second static structure.

9. The turbine engine of claim 7, wherein the second member further defines a third portion, and wherein the gap dimension is defined between the third portion and the second static structure.

10. The turbine engine of claim 1, wherein a second member is coupled to a rotary component.

11. The turbine engine of claim 10, wherein the rotary component at least partially defines a rolling element of a bearing assembly.

12. The turbine engine of claim 11, wherein the second member at least partially defines a bearing surface.

13. The turbine engine of claim 1, wherein the first thermal expansion coefficient is higher than the second thermal expansion coefficient.

14. The turbine engine of claim 1, wherein the first static structure and the second static structure together at least partially define a bearing assembly.

15. A turbine engine, the engine comprising:

a first static structure comprising a first material defining a first thermal expansion coefficient and a second static structure comprising a second material defining a second thermal expansion coefficient different from the first thermal expansion coefficient, wherein the first static structure and the second static structure are together disposed in adjacent arrangement along a load direction, wherein the first static structure and the second static structure together selectively define a gap dimension therebetween along the load direction based at least on a load difference between the first static structure and the second static structure, and wherein the gap dimension is variable between approximately 0.040 millimeters and zero millimeters.

16. A structural support assembly, the structural support assembly comprising:

a first static structure comprising a first material defining a first thermal expansion coefficient; and a second static structure comprising a second material defining a second thermal expansion coefficient different from the first thermal expansion coefficient, wherein the first static structure and the second static structure are together disposed in adjacent arrangement along a load direction, and wherein the first static structure and the second static structure together selectively define a gap dimension therebetween along the load direction to vary between a value greater than zero and zero based at least on a load difference between the first static structure and the second static structure.

17. The structural support assembly of claim 16, further comprising:

a coupling member attaching together the first static structure and the second static structure and further wherein the coupling member at least partially defines a nominal position of the gap dimension between the first static structure and the second static structure.

18. The structural support assembly of claim 17, wherein the coupling member comprises a first member and a second member, wherein the first member and the second member are each coupled together and extend from one another at an angle less than 90 degrees and greater than approximately 15 degrees.

19. The structural support assembly of claim 17, wherein the coupling member comprises a first member and a second member, wherein the second member defines a first portion defining a first stiffness and a second portion defining a second stiffness greater than the first stiffness.

20. The structural support assembly of claim 16, wherein the structural support assembly defines a bearing assembly.

* * * * *